US008899639B2

(12) United States Patent
Ploskunak

(10) Patent No.: US 8,899,639 B2
(45) Date of Patent: Dec. 2, 2014

(54) DOOR CLAMP

(76) Inventor: J. Robert Ploskunak, Murrysville, PA (US)

( * ) Notice: Subject to any disclaimer, the term of this patent is extended or adjusted under 35 U.S.C. 154(b) by 0 days.

(21) Appl. No.: 13/549,562

(22) Filed: Jul. 16, 2012

(65) Prior Publication Data

US 2012/0292929 A1 Nov. 22, 2012

Related U.S. Application Data

(62) Division of application No. 12/370,722, filed on Feb. 13, 2009, now Pat. No. 8,251,412.

(51) Int. Cl.
*E05C 19/18* (2006.01)

(52) U.S. Cl.
USPC ..... 292/288; 292/DIG. 15

(58) Field of Classification Search
CPC ..... E05C 19/003; E05C 19/184; E05C 19/18; E05C 17/54; E05C 17/48; E05C 1/04
USPC ..... 292/288, DIG. 15, 260, 258
See application file for complete search history.

(56) References Cited

U.S. PATENT DOCUMENTS

| | | | | |
|---|---|---|---|---|
| 3,039,195 | A * | 6/1962 | Litty | 33/404 |
| 3,751,810 | A * | 8/1973 | Valva | 33/410 |
| 3,843,984 | A * | 10/1974 | Bagheri et al. | 470/8 |
| 3,844,598 | A * | 10/1974 | Clabaugh | 292/295 |
| 3,896,698 | A * | 7/1975 | Aylott | 411/548 |
| 4,178,026 | A * | 12/1979 | Sinkhorn | 292/295 |
| 4,198,088 | A * | 4/1980 | Tochihara | 292/288 |
| 4,330,146 | A * | 5/1982 | Sessions, Jr. | 292/258 |
| 4,379,576 | A * | 4/1983 | Blough et al. | 292/205 |
| 4,653,785 | A * | 3/1987 | Tobey | 292/258 |
| 6,327,743 | B1 * | 12/2001 | Rashid et al. | 16/82 |
| 6,604,764 | B2 * | 8/2003 | Zemzik | 292/293 |

* cited by examiner

*Primary Examiner* — Mark Williams
(74) *Attorney, Agent, or Firm* — Richard W. James

(57) ABSTRACT

Apparatuses and methods for securing a door. The apparatuses including a door clamp having a stop, a base attached to the stop, a jamb bracket attached to the stop, and a fastener coupled to the jamb bracket.

9 Claims, 8 Drawing Sheets

DOOR CLAMP

CROSS-REFERENCE TO RELATED APPLICATIONS

The present application is a division of U.S. patent application Ser. No. 12/370,722, which was filed Feb. 13, 2009.

FIELD OF THE INVENTION

The present invention is concerned with securing a door. An embodiment of the invention secures a door against an intruder where the intruder can gain access to the doorknob or handle area on both sides of the door.

BACKGROUND OF THE INVENTION

In certain circumstances, it may be desirable to have a locking mechanism that locks a door from the inside—that is from the side toward which the door closes, as opposed to the side toward which the door swings open—where a conventional door lock is not available or can be unlocked from the outside, for example, by use of a key or by breaking a window and reaching through the window to turn the inner doorknob or a lock near the inner doorknob. Such a locking mechanism may, for example, be beneficial in a school classroom setting when there is a lockdown situation where a teacher is instructed to safeguard students in the classroom when there is a disruption or dangerous situation existing elsewhere in or around the school.

In a school classroom, doors typically swing out away from the classrooms and toward the hallway. Moreover, school classroom doors frequently have a locking mechanism that may be operated by key from the outside the classroom, but not from the inside the classroom. Such a door locking arrangement may be desirable to prevent access to the room when it is not to be occupied and to prevent a student or other person from entering the room and locking teachers, administration, or security out of the room. Such a school door locking arrangement may, however, be disadvantageous during, for example, a lockdown situation.

School classroom doors also generally have a window that extends to near the knob. That window could be broken permitting a person outside the door to reach through the window and turn the knob from the inside to circumvent a knob based lock or a lock positioned near the knob. Deadbolts and other locking mechanisms are typically not used in classroom door applications, again, to prevent anyone inside the room from locking the door, such as a student locking a teacher, administrator, or security officer out of the classroom. Thus a door, such as the typical classroom door described hereinabove, may not be suited for a situation where the door is desired to be secured from the inside, for example when a lockdown situation arises.

Accordingly, it may be desirable to have a locking or clamping mechanism that is separate from the door and may be applied to the door from the side on which the door closes to prevent the door from being opened by someone outside the door. Such a door clamp could be self-contained, portable, and able to be secured and accessed by a limited number of people.

Such a door clamp may be used at schools, offices, post offices, hospitals, or any facility where doors open outward and are without a secure built in locking mechanism on the inside. The jamb lock door clamp described herein may thus provide security in situations, including lockdowns, where intruders must be prevented from entering a room.

Certain embodiments of the present door clamping mechanism provide apparatuses and methods to prevent access to a room by preventing a person outside the room from unlocking a door from outside the door and from opening the door by either of its interior or exterior knobs.

SUMMARY OF THE INVENTION

Embodiments of the invention are directed to methods and apparatuses for securing doors.

In accordance with one embodiment, the jamb lock door clamp includes a stop, a base attached to the stop, a jamb bracket attached to the base, and a fastener coupled to the jamb bracket.

In accordance with another embodiment, a jamb lock door clamp includes a threaded, axially bored guide to be threaded through the jamb bracket and to hold the jamb lock door clamp in place while serving as a guide for forming a hole in a door frame. In that method of installing a door clamp, a hollow guide having an axial longitudinal bore through its length is placed in a pin orifice of a door clamp, the door clamp is positioned in relation to a door and door frame, the hollow guide is tightened against the door frame, and a hole is formed in the door frame through the hollow guide.

In accordance with one embodiment of the present invention, a method of securing a door is provided. The method includes positioning a stop portion of a clamp horizontally, sliding the stop portion of the clamp under a door and past a far side of the door, rotating the clamp such that the stop portion is vertical, moving the clamp to adjacent a door frame, and placing a pin extending through the clamp into the door frame.

Accordingly, the present invention provides solutions to the shortcomings of prior door securing systems, apparatuses, and methods. Those of ordinary skill in the art will readily appreciate, therefore, that those and other details, features, and advantages of the present invention will become further apparent in the following detailed description of the preferred embodiments of the invention.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of embodiments of jamb lock door clamping devices and methods of securing a door.

DETAILED DESCRIPTION OF THE INVENTION

Jamb lock door clamping apparatuses and methods of securing a door are described herein. Reference will now be made to embodiments of those door clamping apparatuses and methods of securing a door, examples of which are illustrated in the accompanying drawings. Details, features, and advantages of the jamb lock door clamp will become further apparent in the following detailed description of embodiments thereof. It is to be understood that the figures and descriptions included herein illustrate and describe elements that are of particular relevance to jamb lock door clamping apparatuses and methods of securing a door while eliminating, for purposes of clarity, other elements found in typical door systems.

Any reference in the specification to "one embodiment," "a certain embodiment," or any other reference to an embodiment is intended to indicate that a particular feature, structure or characteristic described in connection with the embodiment is included in at least one embodiment and may be utilized in other embodiments as well. Moreover, the appearances of such terms in various places in the specification are not necessarily all referring to the same embodiment. References to "or" are furthermore intended as inclusive so "or" may indicate one or another of the ored terms or more than one ored term.

Figure 1:
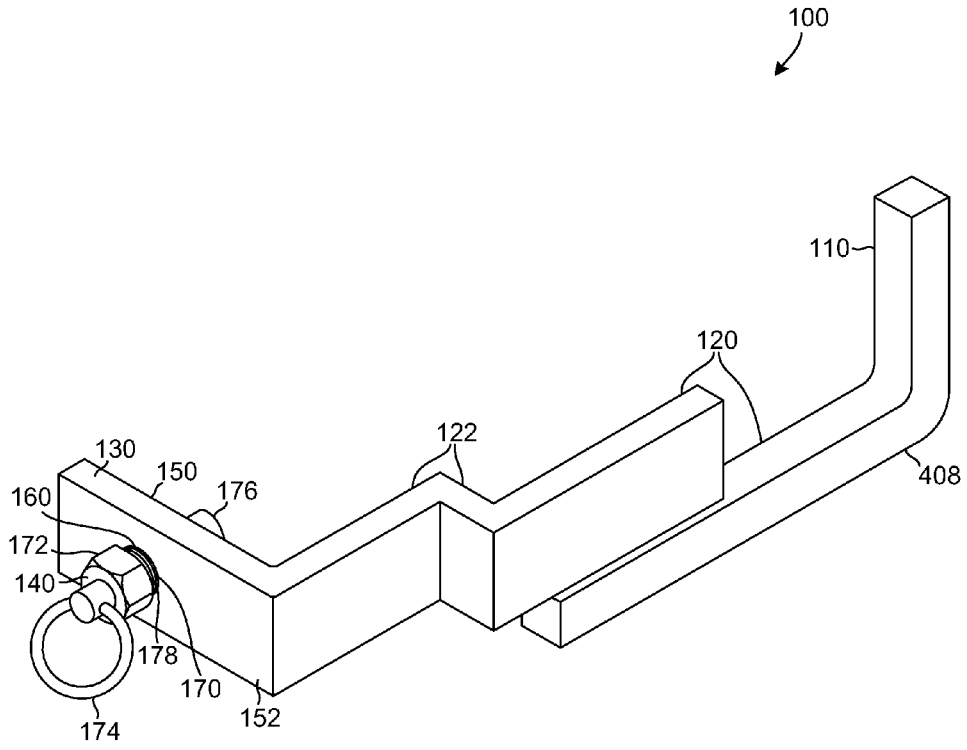
FIG. 1 illustrates an isometric view of an embodiment of a jamb lock door clamp.

FIG. 1 illustrates an isometric view of a jamb lock door clamp 100. The jamb lock door clamp 100 includes a stop 110, a base 120, a jamb bracket 130, and a fastener 140. The door clamp 100 also has an inner side 150 and an outer side 152.

The stop 110 depicted in FIG. 1 is arranged at a 90° or right angle to the base 120 such that the stop 110 may extend along or near an outer surface of a door while the base 120 is situated under the door. The jamb bracket 130 is also arranged at a 90° or right angle to the base 120 and perpendicular to the stop 110 such that the jamb bracket 130 may extend along an inner surface of a door jamb while the base 120 is situated under the door and the stop 110 extends along the door. Alternately, the stop 110 and the jamb bracket 130 may be configured in relation to the base 120 as desired to suit a desired door configuration.

The base 120 illustrated in FIG. 1 includes an angled portion 122 contoured to fit against certain doors. As will be seen in connection door clamp 400 illustrated in FIG. 5, such an angled portion is optional.

A fastener orifice 160 may be created in the jamb bracket 130. The fastener orifice 160 may be a threaded hole such that a threaded portion 178 of a holding pin 170 may be positioned through the fastener orifice 160, as illustrated in FIG. 1. The holding pin 170 may furthermore extend through the fastener orifice 160 and extend past the inner side 150 of the jamb bracket 130.

Figure 1A:
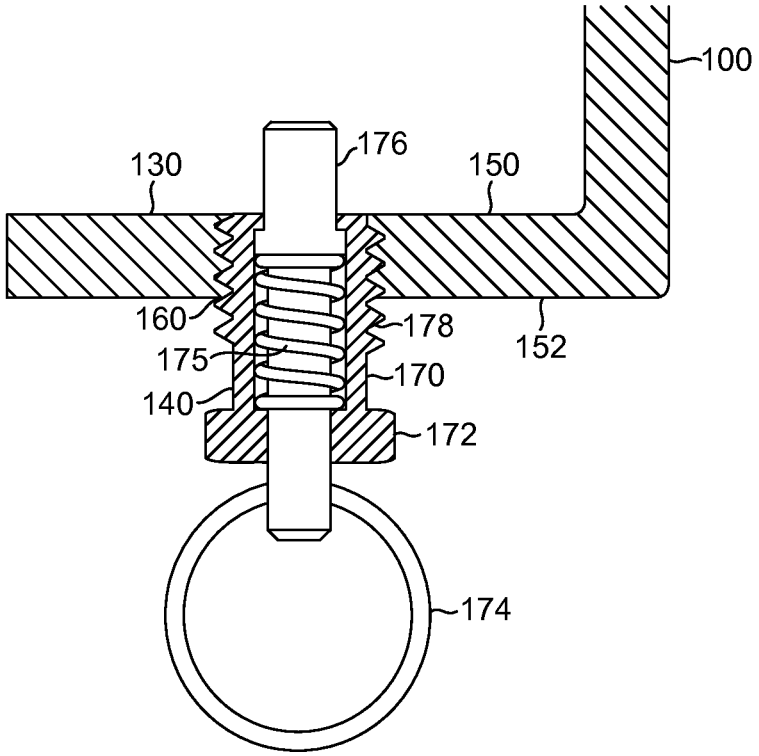
FIG. 1A illustrates a top cutaway view of a portion of the door clamp of FIG. 1 showing the inside of a holding pin threaded into the pin orifice of the door clamp.

FIG. 1A illustrates a top cutaway view of a portion of the door clamp 100 showing the inside of the holding pin 170. In embodiments, the holding pin 170 is a threaded pin with a plunger 176 of the pull-ring, lever, T-handle or other desired type disposed therein. That type of holding pin 170 includes a spring-biased plunger 176 that extends through the threaded portion 178 of the holding pin 170. In such an embodiment, the threaded portion 178 of the holding pin 170 may be threaded into the fastener orifice 160 but not through the inner side 150 of the door clamp 100. The spring-biased plunger 176 may then be pulled against the bias of the spring 175 so that the spring-biased plunger 176 does not extend through the inner side 150 of the door clamp 100 and, when the door clamp 100 is properly positioned, the spring-biased plunger 176 may be released so that the spring-loaded plunger 176 extends through the inner side 150 of the door clamp 100.

The holding pin 170 may have one or more portions formed for ease of turning the holding pin 170 and thereby threading the holding pin 170 through the fastener orifice 160. For example, as shown in FIG. 1, the threaded portion 178 of the holding pin 170 may include a hex head 172 of the type that is frequently turned using a wrench.

Also as shown in FIG. 1, the holding pin 170 may have one or more portions formed to facilitate pulling the spring-biased plunger 176 against the spring-bias, such as the ring 174.

Figure 2:
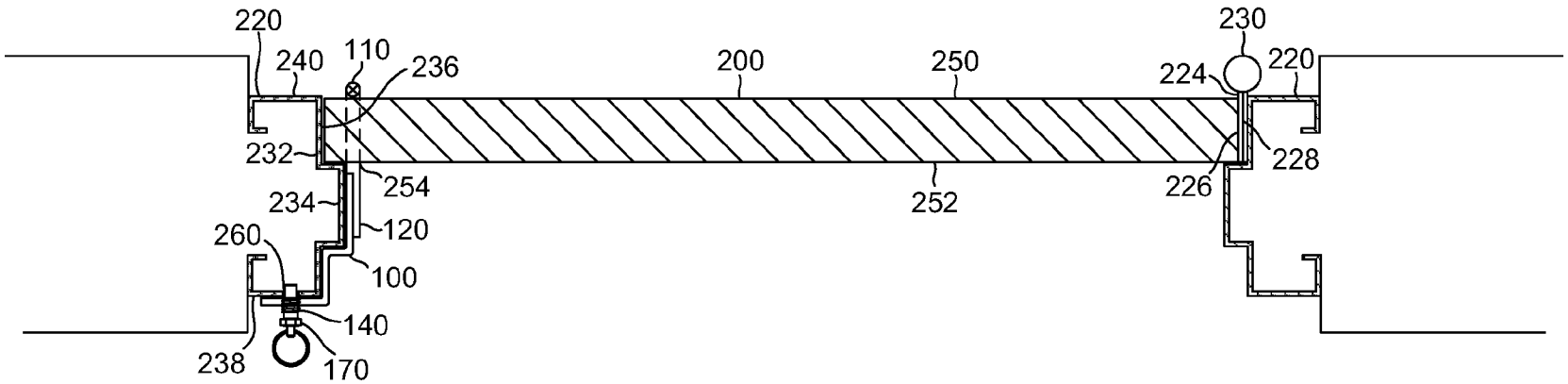
FIG. 2 illustrates a top view of an embodiment of a door and frame with the door clamp of FIG. 1 applied thereto.

FIG. 2 illustrates a top view of an embodiment of a door 200 and frame 220 with a jamb lock door clamp 100 affixed thereto. The door 200 is attached to the frame 220 by hinges 224. The door 200 may be attached by any desired number of hinges 224, from 2 to 4 or more. The hinges 224 typically include two halves, a door side hinge 226 and a frame side hinge 228, coupled by a hinge pin 230 such that the door side hinge 226 and the frame side hinge 228 rotate around the hinge pin 230, permitting the door 200 to swing open in one direction and closed in the opposite direction. The hinges 224 are commonly attached to the door 200 and the frame 220 by screws, but may be attached in any way desired.

The door 200 latches into a latch side jamb 232 portion of the frame 220. A strip 232 extends from the frame 220 or is formed in the frame 220 to stop the door 200 when the door 200 is closed. The door frame 220 further includes a facing surface 236 adjacent the door 200 when the door 200 is closed, an inner surface 238, and an outer surface 240.

The door 200 has an outer side 250 facing the direction in which the door swings open and an inner side 252 facing the direction toward which the door 200 swings closed. The edge 254 of the inner side 252 of the door 200 thus rests adjacent the strip 232 when the door is closed.

A fastener hole 260 may be created in the door frame 220 for positive engagement of the door clamp 100 to the door frame 220. The fastener hole 260 in the door frame 220 may be created in various ways. For example, the fastener hole 260 may be created by positioning the jamb lock door clamp 200 and marking the hole through the fastener orifice 160 with a scriber, pencil, or other marking instrument. Then the jamb lock door clamp 200 may be removed and a hole may be drilled or otherwise formed in the door frame 220 at the mark so that the holding pin 170 can extend into the door frame 220 when the jamb lock door clamp 100 is positioned in its locking position. It should be noted that the fastener hole 260 in the door frame 220 may be threaded, but need not necessarily be threaded to secure the jamb lock door clamp 100 in place by way of the holding pin 170 because movement of the jamb lock door clamp 100 lengthwise along the base 120 is limited by the stop 110 contacting the outer side 250 of the door 200.

Figure 3:
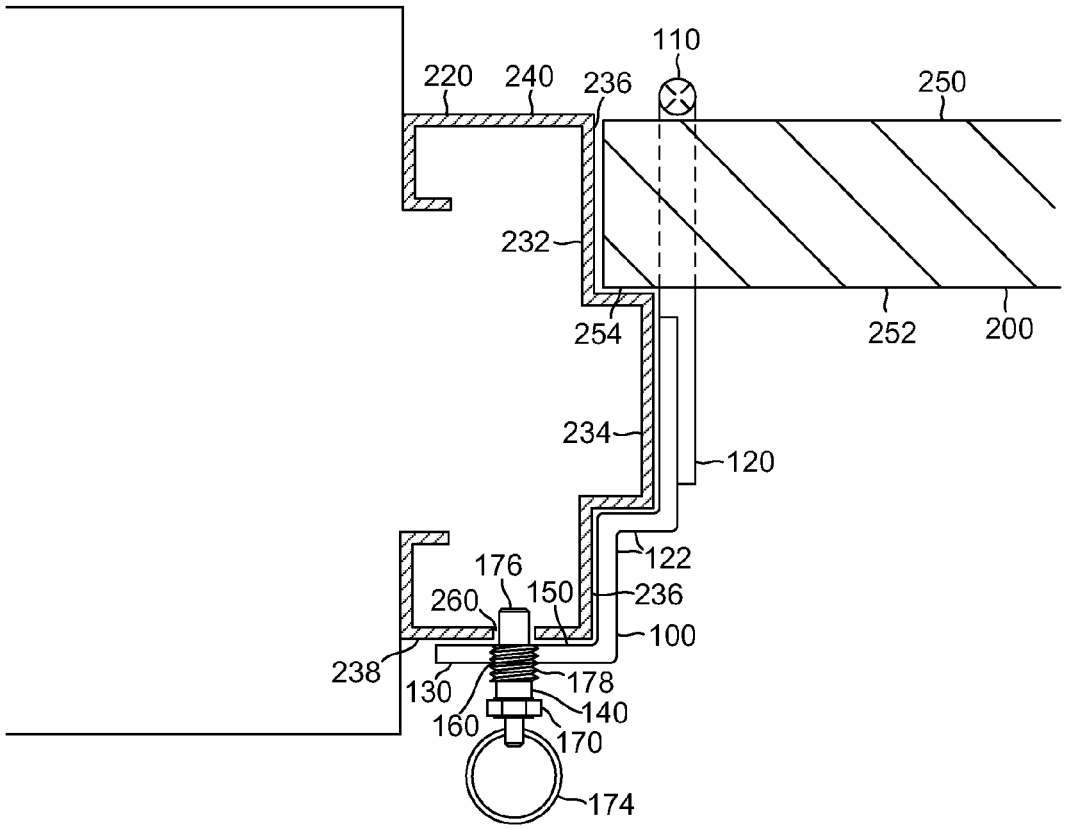
FIG. 3 illustrates an enlarged top view of a portion of the door, frame, and door clamp depicted in FIG. 2.

FIG. 3 is an enlarged view of a portion of the door 200 and frame 220 depicted in FIG. 2 having the jamb lock door clamp 100 affixed thereto. The door clamp 100 may be shaped as desired to fit any desired door. For example, the door clamp 100 depicted in FIGS. 1, 2, and 3 has a bend 122 in the base 120 to fit around the strip 234 attached to a door frame 220. In that embodiment, the bend 122 of the base 120 extends along the strip 234 and facing surface 236 of the frame 220. The jamb bracket 130 turns perpendicular to the base 120 to extend along the inner surface 238 of the door frame 220. In that embodiment, the holding pin 170 extends perpendicular to the inner side 252 and outer side 250 of the door 200 through the jamb bracket 130 and into the door frame 220. In that embodiment, the holding pin 170, when inserted into the fastener hole 260, prevents the jamb lock door clamp 100 from moving away from the door frame 220.

The jamb lock door clamp 100 may be used to secure a door, such as the door 200 illustrated in FIG. 2, quickly and easily. In an embodiment of door clamp 100 operation, the door clamp 100 depicted in FIG. 1 is positioned on the floor near the door 200. The door clamp 100 is positioned such that the stop 110 of the door clamp 100 is horizontal. The stop 110 is then slid under the door 200 and past the outer side 250 of the door 200. Once the stop 110 is extended past the outer side 250 of the door 200, the door clamp 100 is rotated 90° so that the stop 110 is vertical. The door clamp 100 is then moved to adjacent the door frame 220. As may be seen in FIG. 2, the stop 110 of the door clamp 100 may be positioned against the side of the door frame 220 opposite the hinges 224 that swings away from the door frame 220. The holding pin 170 may then be placed against or extended into the door frame 220.

As may be seen in FIG. 3, the holding pin 170 may be placed through the door clamp 100 as desired, including by threading a portion 178 of the holding pin 170 into the door clamp 100. The holding pin 170 may furthermore extend through the door clamp 100 into the door frame 220 by pulling the spring-biased plunger 176 of the holding pin 170 until the spring-biased plunger 176 of the holding pin 170 is nearly flush with the inner surface 150 of the door clamp 100, moving the door clamp 100 toward or against the door frame 220 so that the holding pin 170 is aligned with the fastener hole 260 in the door frame 220, and releasing the spring biased plunger 176 of the holding pin 170 such that the spring biased plunger 176 extends into the fastener hole 260 in the door frame 220.

Thus, the threaded portion 178 of the holding pin 170 may be screwed into the door clamp 100 by hand, wrench or as desired, and remain there when the door clamp 100 is not in use. Then, when the door clamp 100 is used, the person positioning the door clamp 100 may pull the spring-biased plunger 176 using the ring 174 or otherwise as desired, until the holding pin 170 is in contact with the door frame 220. The user may then release the spring-biased plunger 176 and move the door clamp 100 until the holding pin 170 is aligned with the fastener hole 260 in the door frame 220 and the spring-biased plunger 176 extends into the fastener hole 260 in the door frame 220.

Figure 4:
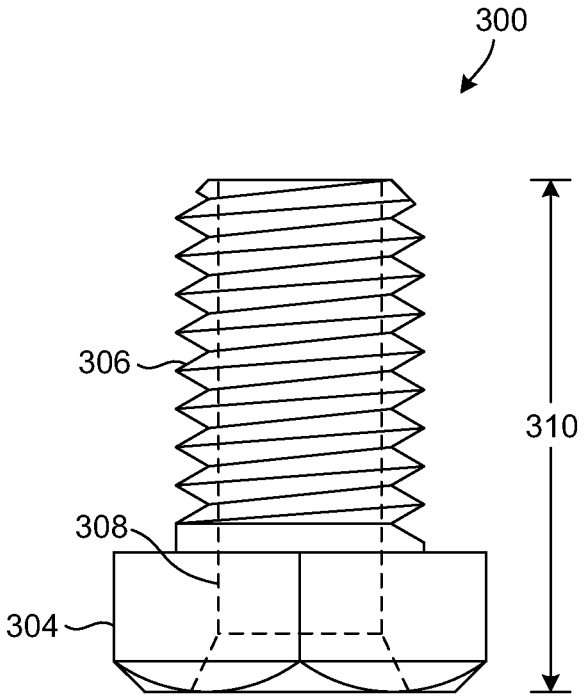
FIG. 4 illustrates a side view of a hollow bolt guide.

FIG. 4 illustrates a hollow guide 300 that may be used when creating the fastener hole 260 in the door frame 220. The hollow guide 300 may be a standard machine threaded bolt, axially bored through the hollow guide 300. Thus the hollow guide 300 depicted in FIG. 4 is, bored longitudinally through the center and for the length of the hollow guide 300. The hollow guide 300 embodiment depicted in FIG. 4 includes a hex head 304, an externally threaded shaft 306, and an axial bore 308 through the longitudinal length 310 of the hollow guide 300.

In operation, the hollow guide 300 may be threaded into the fastener orifice 160 of the jamb lock door clamp 100. The door clamp 100 may then be positioned against a door 200 and door frame 220 and the hollow guide 300 may be tightened against the door frame 220. Next, a fastener hole 260 may be bored into the door frame 220 through the hollow guide 300 by any means desired. In an embodiment, the fastener hole 260 is drilled into the door frame 220 using a drill having a bit that extends through the hollow guide 300. After the fastener hole 260 has been formed in the door frame 220, the hollow guide 300 may be removed from the door clamp 100 and the holding pin 170 may be threaded into the door clamp 100 in place of the hollow guide 300.

Figure 5:
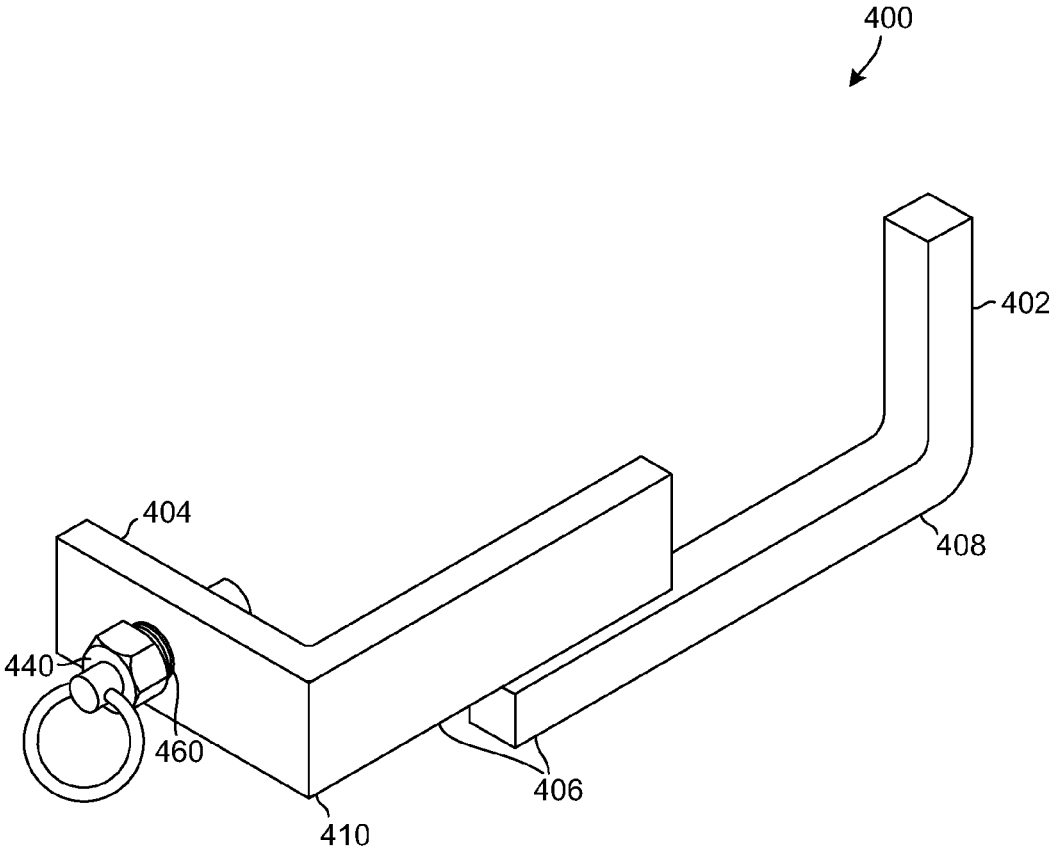
FIG. 5 illustrates an isometric view of another embodiment of a jamb lock door clamp.

FIG. 5 illustrates an embodiment of the jamb lock door clamp 400 in the form of a hooked bracket. The hooked bracket type door clamp 400 includes a door hook portion 402 that slips under a door 200 and is turned to be positioned adjacent the outer side 250 of the door 200. The hooked bracket type door clamp 400 illustrated in FIG. 5 also includes a frame hook portion 404 that is placed adjacent the door frame 220. The door hook portion 402 extends from a first end 408 of a central portion 406 and the frame hook portion 404 extends from an opposite second end 410 of the central portion 406 in the embodiment depicted in FIG. 5. A fastener 440, such as the holding pin 170 described hereinabove, may be placed through an orifice 460 in the jamb lock door clamp 400. In the embodiment illustrated in FIG. 5, the orifice 460 is located in the frame hook portion 404 of the jamb lock door clamp 400 such that the fastener 440 can extend into the inner surface 238 of the door frame 220. It should be noted that the frame hook portion 404 may not be necessary in certain embodiments where the door clamp 400 may be pinned, attached, or otherwise secured to the facing surface 236 of the door frame 220 without turning along the inner surface 238 of the door frame 220. Thus, the orifice 460 may be located in the jamb lock door clamp 400 such that the fastener 440 extends into the inner surface 238 of the door frame 220.

An embodiment of a method of installing the jamb lock door clamp 400 includes threading the hollow guide 300 depicted in FIG. 4 into the jamb lock door clamp 400. The jamb lock door clamp 400 is then positioned around the door 200 and against the door frame 220 as it is to be used. A fastener hole 260 is then created in the door frame 220 so that, when the hollow guide 300 is replaced with the fastener 440, the fastener 440 can extend through the jamb lock door clamp 400 into a fastener hole 260 in the door frame 220, thereby securing the jamb lock door clamp 400 in its locking position.

Figure 6:
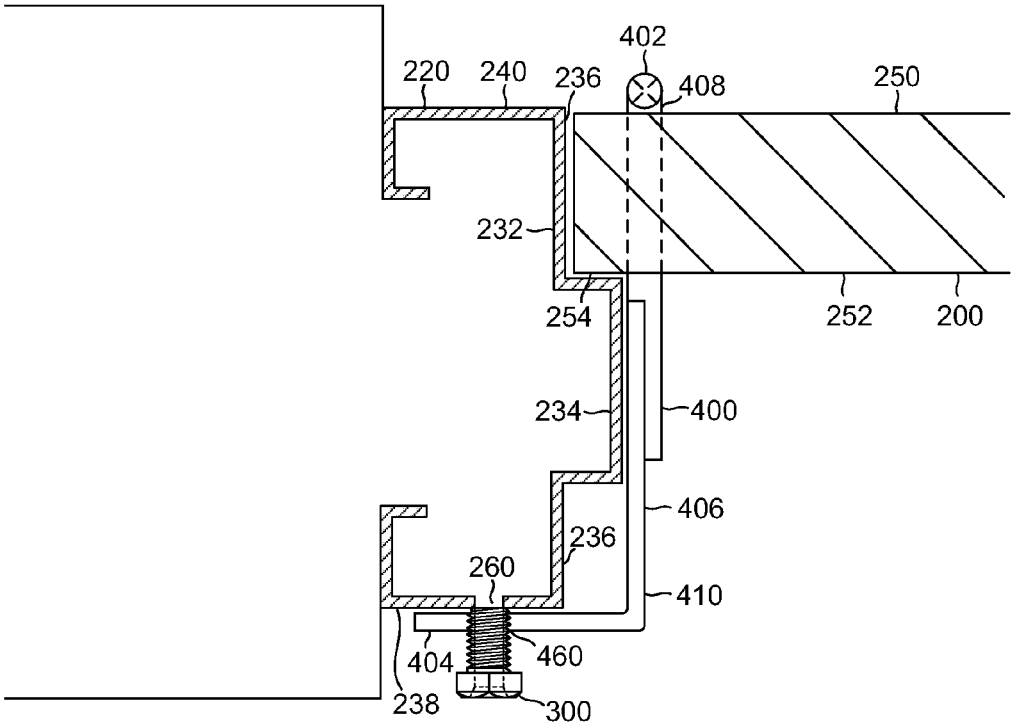
FIG. 6 illustrates a top view of the door clamp of FIG. 5 positioned adjacent the door and frame of FIG. 2 with the hollow guide of FIG. 4 positioned for forming a fastener hole.

FIG. 6 illustrates a top view of the door clamp 400 positioned adjacent a door 200 and frame 220 with the hollow guide 300 positioned for forming a fastener hole 260 in the door frame 220. As may be seen, the door clamp 400 is positioned adjacent the door frame 220 and the hollow guide 300 is threaded through the orifice 460 and tightened against the inner surface 238 of the door frame 220 to hold the door clamp 400 in place. The fastener hole 260 may then be formed through the hollow guide 300 by, for example, drilling through the hollow guide 300 into the door frame 220.

Figure 7:
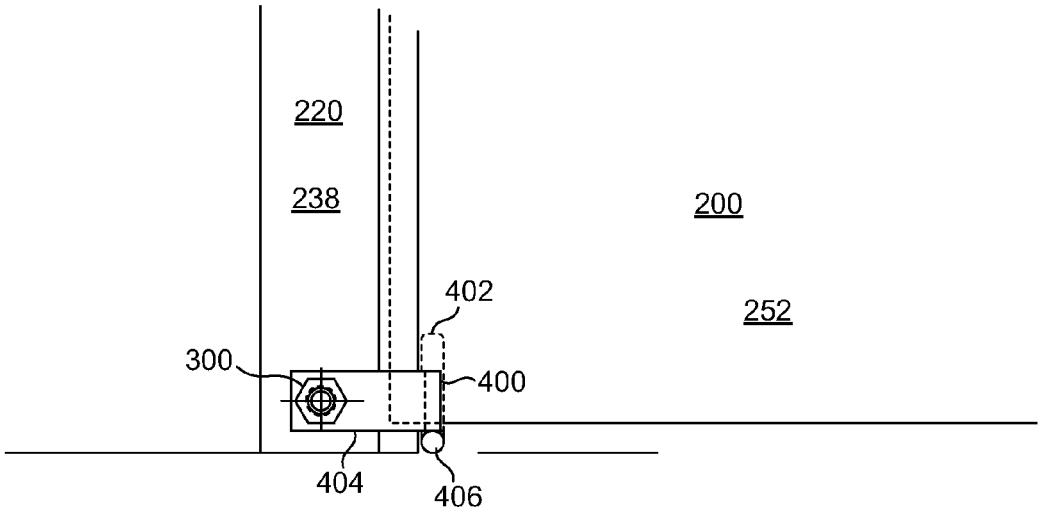
FIG. 7 illustrates a side view of a portion of the inner side of the door and frame of FIG. 2 with the door clamp of FIG. 5 and hollow guide of FIG. 4.

FIG. 7 illustrates a view of a portion of the inner side of the door 252 and frame 220 illustrated in FIG. 6. A jamb lock door clamp 400 is positioned adjacent the door 200 and frame 220 with the hollow guide 300 holding the door clamp 400 in place for drilling the fastener hole 260.

Figure 8:
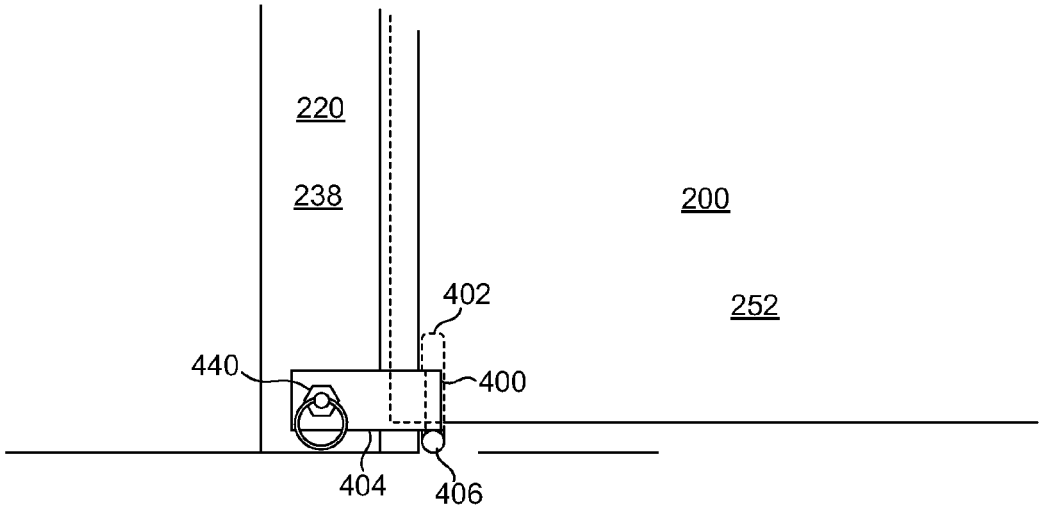
FIG. 8 illustrates the portion of the inner side of the door and frame of FIG. 7 with the door clamp of FIG. 5 and a holding pin threaded into the pin orifice of the door clamp.

FIG. 8 illustrates the portion of the inner side of the door 252 illustrated in FIG. 6 with the hollow guide 300 removed from the door clamp 400 and the fastener 440 threaded into the fastener orifice 160 of the door clamp 400 in place of the hollow guide 300. As may be seen in FIG. 8, the door hook portion 402 of the door clamp 400 is positioned adjacent the outer side 250 of the door 200 and the frame hook portion 404 is fastened to the door frame 220 by the fastener 440.

Whether including or not including the frame hook portion 404, the door clamp 400 can be attached to a door 200 and frame 220 by hand in seconds without tools or keys and is independent of a doorknob or handle assembly. The jamb lock door clamp 400 can furthermore be put in place and removed from inside a room without opening the door 200.

When operating the embodiment of the jamb lock door clamp 400 illustrated in FIG. 5, a user may rotate the jamb lock door clamp 400 such that the door hook portion 402 extends parallel to the floor and the perpendicular frame hook portion 404 extends upward from the floor. The jamb lock door clamp 400 may then be slid under the door 200 and rotated so that the door hook portion 402 extends up along the outer side 250 of the door 200 and the perpendicular frame hook portion 404 of the jamb lock door clamp 400 extends along the inner side 238 of the frame 220. The fastener 440 may then be placed through the jamb lock door clamp 400 such that the fastener 440 extends into the door frame 220.

The jamb lock door clamp 400, when placed in its locking position, thus extends under the door 200, clamping the outer side 250 of the door 200 against the door frame 220 inside the room. When positioned such, the jamb lock door clamp 400 secures a door 200 closed against the door frame 220. When securing the door 200, the door hook portion 402 extends along the outer side 250 of the door 200, the central portion 400 extends under the door 200, the frame hook portion 404 extends along the door frame 220 and the fastener 440 extends through the jamb lock door clamp 200 into the door frame 220.

While the present invention has been disclosed with reference to certain embodiments, numerous modifications, alterations, and changes to the described embodiments are possible without departing from the scope of the present invention, as defined in the appended claims. Accordingly, it is intended that the present invention not be limited to the described embodiments, but that it have the full scope defined by the language of the following claims, and equivalents thereof.

What is claimed is:

1. A door clamping device comprising:

a stop having a width dimensioned to fit under a closed door such that the stop can be slid from an inner side of the door, under the door, and past an outer side of the door when positioned horizontally and having a length that extends along a surface of the door when positioned vertically;

a base having a first end and a second end, the first end fixedly attached to the stop, the base having a cross-section that, at its widest diameter, fits under the closed door and rotates under the closed door;

a jamb bracket fixedly attached to the second end of the base and dimensioned such that the jamb bracket extends along a surface of a door frame adjacent the inner side of the closed door when the stop is positioned vertically; and a fastener coupled to the jamb bracket to extend into a fastener hole in the door frame when the jamb bracket extends along the door frame.

2. The door clamping device of claim 1, wherein the base has a length from the first end to the second end and wherein the stop is fixedly attached to the first end of the base at a right angle.

3. The door clamping device of claim 2, wherein the jamb bracket is fixedly attached to the second end of the base at a right angle perpendicular to the stop.

4. The door clamping device of claim 1, wherein the fastener is threaded through the jamb bracket.

5. The door clamping device of claim 1, further comprising a strike angle between the base and the jamb bracket.

6. The door clamping device of claim 4, wherein the fastener includes a threaded pin having a spring-loaded plunger extending therethrough, the spring-loaded plunger for extending into a void in a door jamb.

7. The door clamping device of claim 4, further comprising a threaded hollow bolt to be threaded through the jamb bracket and through which the fastener hole is to be formed in the door frame.

8. The door clamping device of claim 7, wherein the fastener and the threaded hollow bolt are interchangeable.

9. The door clamping device of claim 1, wherein the base is configured to extend under a closed door, the stop is configured to extend vertically adjacent to an outer side of a door, the jamb bracket is configured to extend along a door jamb on an inner side of the door, and the fastener is configured to extend through the jamb bracket and the door jamb.

* * * * *